US008910781B2

(12) United States Patent
Pipes et al.

(10) Patent No.: US 8,910,781 B2
(45) Date of Patent: Dec. 16, 2014

(54) CONTAINER FOR SMOKELESS TOBACCO PRODUCTS AND RELATED PACKAGED PRODUCT ASSEMBLY AND METHOD

(71) Applicant: R.J. Reynolds Tobacco Company, Winston-Salem, NC (US)

(72) Inventors: Jerry Wayne Pipes, Clemmons, NC (US); Pankaj Patel, Clemmons, NC (US); Melissa Ann Clark, Mocksville, NC (US); Laya Katina Palmer Horton, Winston-Salem, NC (US); William Travis Lintner, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 0 days.

(21) Appl. No.: 13/739,776

(22) Filed: Jan. 11, 2013

(65) Prior Publication Data

US 2014/0197054 A1 Jul. 17, 2014

(51) Int. Cl.
*A24F 23/00* (2006.01)
*B65B 7/28* (2006.01)

(52) U.S. Cl.
CPC .. *A24F 23/00* (2013.01); *B65B 7/28* (2013.01)
USPC ..... 206/242; 206/236; 206/38; 220/780; 220/784; 220/794; 220/795; 220/796

(58) Field of Classification Search
USPC ..... 206/216, 38, 236, 242; 220/305, 780, 220/784, 794–806; 53/452, 467, 473, 476
See application file for complete search history.

(56) References Cited

U.S. PATENT DOCUMENTS 411,773 A 10/1889 Atkinson
464,933 A 12/1891 Bradley
(Continued)

FOREIGN PATENT DOCUMENTS

CA 1072895 3/1980
CA 2547369 11/2006
(Continued)

OTHER PUBLICATIONS

U.S. Appl. No. 29/408,134, filed Dec. 7, 2011, Pipes.
(Continued)

*Primary Examiner* — Mickey Yu
*Assistant Examiner* — Brijesh V. Patel
(74) *Attorney, Agent, or Firm* — Womble Carlyle Sandridge & Rice, LLP

(57) ABSTRACT

A container configured to hold one or more units of a product is provided. The container may comprise a lid and a base. The lid may comprise a top wall and one or more lid sidewalls extending to a lower lip. A sealing member may be provided at the top wall in a channel defined therein. The base may comprise a bottom wall and one or more base sidewalls extending to an upper lip. Protrusions may extend from the base sidewalls. The lid may be moveable with respect to the base between a decoupled configuration and a coupled configuration. In the coupled configuration, the upper lip of the base may contact the sealing member of the lid to seal shut a storage compartment defined in the base. Further, the lower lip may engage the protrusions to retain the lid in the coupled configuration. A related method is also provided.

19 Claims, 9 Drawing Sheets

(56) References Cited

U.S. PATENT DOCUMENTS

| | | | | | |
|---|---|---|---|---|---|
| D26,315 | S | | 11/1896 | Miller | |
| D28,413 | S | | 3/1898 | Taite | |
| 663,415 | A | | 12/1900 | Charles | |
| 1,072,820 | A | | 9/1913 | Carnes | |
| 1,083,104 | A | | 12/1913 | Johnson | |
| 1,212,147 | A | | 1/1917 | Peterson | |
| 1,331,470 | A | | 2/1920 | Luckett | |
| 1,344,650 | A | | 6/1920 | Peterson | |
| 1,381,831 | A | | 6/1921 | Heeren | |
| 1,667,460 | A | | 4/1928 | Hussey | |
| 1,992,152 | A | | 2/1935 | Yeates | |
| 2,023,341 | A | | 12/1935 | Downes-Shaw et al. | |
| 2,047,951 | A | | 7/1936 | Eberhart | |
| 2,047,977 | A | | 7/1936 | McGowan | |
| 2,109,805 | A | | 3/1938 | Stewart | |
| 2,117,228 | A | | 5/1938 | Stuchbery | |
| 2,206,534 | A | | 7/1940 | Higbee | |
| 2,332,245 | A | | 10/1943 | Moll | |
| 2,339,343 | A | * | 1/1944 | Magnesen | 215/274 |
| 2,403,131 | A | | 7/1946 | Smith | |
| 2,412,528 | A | | 12/1946 | Morrell | |
| 2,415,609 | A | | 2/1947 | Sebell | |
| 2,523,251 | A | | 9/1950 | Pantalone et al. | |
| 2,551,615 | A | | 5/1951 | Maher | |
| 2,977,019 | A | * | 3/1961 | Henchert | 220/784 |
| 3,010,596 | A | | 11/1961 | Williams et al. | |
| 3,017,048 | A | * | 1/1962 | Foye | 215/345 |
| D193,219 | S | | 7/1962 | Burdick et al. | |
| 3,042,247 | A | | 7/1962 | Bonnet | |
| 3,088,830 | A | | 5/1963 | Graham | |
| 3,170,588 | A | | 2/1965 | Lyon, Jr. | |
| 3,206,016 | A | | 9/1965 | Fowle et al. | |
| 3,292,810 | A | | 12/1966 | Schechter | |
| 3,362,556 | A | | 1/1968 | Waldrum | |
| 3,380,621 | A | | 4/1968 | Rissberger, Jr. et al. | |
| 3,387,640 | A | | 6/1968 | Butler | |
| 3,392,873 | A | | 7/1968 | Old, Jr. | |
| 3,437,224 | A | | 4/1969 | Williams | |
| 3,445,023 | A | | 5/1969 | Giessler et al. | |
| 3,558,036 | A | | 1/1971 | DeVoe | |
| 3,574,147 | A | | 4/1971 | Giessler et al. | |
| 3,610,306 | A | | 10/1971 | Summers | |
| 3,721,365 | A | | 3/1973 | Saunders | |
| 3,796,681 | A | | 3/1974 | Ratliff et al. | |
| 3,811,592 | A | | 5/1974 | Dye | |
| 3,874,556 | A | | 4/1975 | Finkelston, Jr. | |
| 3,894,654 | A | * | 7/1975 | Frankenberg | 220/283 |
| 3,907,953 | A | | 9/1975 | Wheeler | |
| 3,910,444 | A | | 10/1975 | Foster | |
| 4,008,930 | A | | 2/1977 | Swainson | |
| 4,037,746 | A | | 7/1977 | Ver Hage | |
| 4,098,421 | A | | 7/1978 | Foster | |
| 4,190,170 | A | * | 2/1980 | Boyd | 215/307 |
| 4,202,462 | A | | 5/1980 | Imber | |
| 4,442,971 | A | | 4/1984 | Helms | |
| 4,562,685 | A | | 1/1986 | Tomita et al. | |
| 4,612,943 | A | | 9/1986 | Meinkowsky | |
| 4,615,439 | A | | 10/1986 | Weissenfels | |
| 4,646,933 | A | | 3/1987 | Jurczenia et al. | |
| 4,660,577 | A | | 4/1987 | Sensabaugh et al. | |
| 4,703,765 | A | | 11/1987 | Paules et al. | |
| 4,705,165 | A | | 11/1987 | Thieke | |
| 4,711,687 | A | | 12/1987 | Paules | |
| 4,715,496 | A | | 12/1987 | Hackmann | |
| 4,727,999 | A | | 3/1988 | Gach | |
| 4,846,361 | A | | 7/1989 | Haffner | |
| 4,850,504 | A | | 7/1989 | Grindrod et al. | |
| 5,259,526 | A | | 11/1993 | Stolzman | |
| 5,443,853 | A | | 8/1995 | Hayes | |
| 5,460,287 | A | | 10/1995 | Cargile et al. | |
| 5,538,154 | A | | 7/1996 | Von Holdt | |
| 5,566,568 | A | | 10/1996 | Rojek | |
| 5,566,854 | A | * | 10/1996 | Rojek | 220/658 |
| 5,660,290 | A | | 8/1997 | Hayes | |
| 5,676,272 | A | | 10/1997 | Baerenwald | |
| 5,686,127 | A | | 11/1997 | Stockley, III et al. | |
| 5,752,599 | A | | 5/1998 | Veltman | |
| 5,782,371 | A | * | 7/1998 | Baerenwald et al. | 220/4.22 |
| 5,791,473 | A | | 8/1998 | Decker et al. | |
| 5,794,814 | A | | 8/1998 | Baerenwald | |
| D407,972 | S | | 4/1999 | Hilton | |
| D412,786 | S | | 8/1999 | Killinger | |
| 6,032,792 | A | | 3/2000 | Faraj | |
| D427,432 | S | | 7/2000 | Au et al. | |
| 6,102,227 | A | | 8/2000 | Cochrane | |
| 6,170,490 | B1 | | 1/2001 | Barrow | |
| 6,298,857 | B1 | | 10/2001 | Schmidt | |
| D456,713 | S | | 5/2002 | Bried et al. | |
| D460,692 | S | | 7/2002 | Cumberbatch | |
| D462,613 | S | | 9/2002 | Bried et al. | |
| D464,886 | S | | 10/2002 | Bried et al. | |
| 6,477,823 | B1 | | 11/2002 | Kitterman et al. | |
| D469,607 | S | * | 2/2003 | Wolff | D3/294 |
| D476,575 | S | | 7/2003 | Steele, IV et al. | |
| 6,726,006 | B1 | | 4/2004 | Funderburk et al. | |
| D494,474 | S | | 8/2004 | Houk et al. | |
| D499,025 | S | | 11/2004 | Houk et al. | |
| D510,524 | S | | 10/2005 | Houk et al. | |
| D512,636 | S | | 12/2005 | Pace | |
| D513,386 | S | | 1/2006 | Pace et al. | |
| D514,936 | S | | 2/2006 | Pace et al. | |
| D515,426 | S | | 2/2006 | Pace et al. | |
| D515,429 | S | | 2/2006 | Pace | |
| D515,439 | S | | 2/2006 | Pace | |
| D515,928 | S | | 2/2006 | Pace | |
| 7,014,039 | B2 | * | 3/2006 | Henson et al. | 206/267 |
| D518,728 | S | | 4/2006 | Frantz | |
| D523,752 | S | | 6/2006 | Bried et al. | |
| 7,059,492 | B2 | | 6/2006 | Giraud et al. | |
| D525,120 | S | | 7/2006 | Maskell et al. | |
| D527,995 | S | | 9/2006 | Tanner | |
| D531,036 | S | | 10/2006 | Bried et al. | |
| D541,176 | S | | 4/2007 | Bried | |
| D548,070 | S | | 8/2007 | Swain | |
| D587,109 | S | | 2/2009 | Lyon et al. | |
| D592,494 | S | | 5/2009 | Wichowski | |
| D592,498 | S | | 5/2009 | Cronin | |
| 7,537,110 | B2 | | 5/2009 | Kutsch et al. | |
| D594,154 | S | | 6/2009 | Patel et al. | |
| D600,855 | S | | 9/2009 | Krohn | |
| D612,094 | S | | 3/2010 | Bellamah et al. | |
| 7,798,319 | B1 | | 9/2010 | Bried et al. | |
| D625,178 | S | | 10/2010 | Bailey et al. | |
| D630,505 | S | | 1/2011 | Westemeyer et al. | |
| D630,525 | S | | 1/2011 | Patel et al. | |
| D631,353 | S | | 1/2011 | Gelardi et al. | |
| D631,354 | S | | 1/2011 | Gelardi et al. | |
| D631,747 | S | | 2/2011 | Gelardi et al. | |
| D638,297 | S | | 5/2011 | Gelardi et al. | |
| 7,946,450 | B2 | | 5/2011 | Gelardi et al. | |
| D639,162 | S | | 6/2011 | Gelardi et al. | |
| D639,163 | S | | 6/2011 | Gelardi et al. | |
| D640,131 | S | | 6/2011 | Gibson et al. | |
| D646,159 | S | | 10/2011 | Bellamah et al. | |
| D646,966 | S | | 10/2011 | Gill et al. | |
| 8,033,425 | B2 | | 10/2011 | Gelardi | |
| D649,284 | S | | 11/2011 | Patel et al. | |
| 8,051,979 | B2 | | 11/2011 | Smith et al. | |
| 8,066,123 | B2 | | 11/2011 | Gelardi | |
| D650,268 | S | | 12/2011 | Gibson et al. | |
| 8,096,411 | B2 | | 1/2012 | Bailey et al. | |
| 8,117,807 | B2 | | 2/2012 | Bellamah et al. | |
| D658,377 | S | | 5/2012 | Corwin et al. | |
| D665,253 | S | | 8/2012 | Bellamah et al. | |
| D667,301 | S | | 9/2012 | Jones et al. | |
| D667,302 | S | | 9/2012 | Jones et al. | |
| D667,303 | S | | 9/2012 | Jones et al. | |
| D667,304 | S | | 9/2012 | Jones et al. | |
| D673,848 | S | | 1/2013 | Bailey et al. | |
| D674,688 | S | | 1/2013 | Loftin et al. | |
| D675,516 | S | | 2/2013 | Horton et al. | |
| D676,321 | S | | 2/2013 | Jones et al. | |
| 8,458,996 | B2 | | 6/2013 | Bried et al. | |
| D690,588 | S | | 10/2013 | Pipes et al. | |

(56) References Cited

U.S. PATENT DOCUMENTS

| | | | | |
|---|---|---|---|---|
| D692,298 | S | 10/2013 | Pipes et al. | |
| D694,102 | S | 11/2013 | Bellamah et al. | |
| 2003/0111359 | A1 | 6/2003 | Seliga et al. | |
| 2003/0188442 | A1 | 10/2003 | Imer | |
| 2004/0217116 | A1* | 11/2004 | Offerman et al. | 220/345.2 |
| 2005/0279657 | A1* | 12/2005 | Bjerregaard et al. | 206/308.1 |
| 2006/0054626 | A1 | 3/2006 | Delcroix et al. | |
| 2006/0060480 | A1 | 3/2006 | Budd | |
| 2006/0101564 | A1 | 5/2006 | Powdermaker | |
| 2006/0118589 | A1 | 6/2006 | Arnarp et al. | |
| 2008/0029116 | A1 | 2/2008 | Robinson et al. | |
| 2008/0156338 | A1 | 7/2008 | Winterson et al. | |
| 2008/0156805 | A1 | 7/2008 | Perry et al. | |
| 2008/0202956 | A1 | 8/2008 | Welk et al. | |
| 2008/0210249 | A1 | 9/2008 | Luzenberg | |
| 2008/0215440 | A1* | 9/2008 | Peterson et al. | 705/14 |
| 2009/0000968 | A1 | 1/2009 | Smith et al. | |
| 2009/0014343 | A1 | 1/2009 | Clark et al. | |
| 2009/0014450 | A1 | 1/2009 | Bjorkholm | |
| 2009/0223988 | A1* | 9/2009 | Wichowski | 220/796 |
| 2010/0012534 | A1* | 1/2010 | Hoffman | 206/265 |
| 2010/0018882 | A1* | 1/2010 | St. Charles | 206/242 |
| 2010/0018883 | A1 | 1/2010 | Patel | |
| 2010/0043359 | A1 | 2/2010 | Skiffington et al. | |
| 2010/0065076 | A1 | 3/2010 | Bergstrom et al. | |
| 2010/0065077 | A1 | 3/2010 | Lofgreen-Ohrn et al. | |
| 2010/0133140 | A1 | 6/2010 | Bailey et al. | |
| 2011/0000931 | A1 | 1/2011 | Gelardi et al. | |
| 2011/0011866 | A1* | 1/2011 | Dunwoody | 220/310.1 |
| 2011/0186579 | A1* | 8/2011 | Bailey et al. | 220/495.01 |
| 2011/0204074 | A1 | 8/2011 | Gelardi et al. | |
| 2012/0074157 | A1* | 3/2012 | Dunwoody | 220/780 |
| 2012/0193265 | A1 | 8/2012 | Patel et al. | |
| 2012/0285125 | A1 | 11/2012 | Bailey | |
| 2013/0319886 | A1 | 12/2013 | Ledermann | |

FOREIGN PATENT DOCUMENTS

| | | |
|---|---|---|
| CH | 694145 | 8/2004 |
| DE | 202004007079 | 7/2004 |
| EP | 0219297 | 4/1987 |
| EP | 0 806 367 | 11/1997 |
| FR | 825824 | 3/1938 |
| FR | 1565966 | 5/1969 |
| FR | 2361278 | 3/1978 |
| GB | 340646 | 1/1931 |
| GB | 410775 | 5/1934 |
| GB | 443073 | 2/1936 |
| GB | 443557 | 3/1936 |
| GB | 451222 | 7/1936 |
| GB | 472427 | 9/1937 |
| GB | 593653 | 10/1947 |
| GB | 693074 | 6/1953 |
| GB | 887480 | 1/1962 |
| GB | 910525 | 11/1962 |
| GB | 1004671 | 9/1965 |
| GB | 1159199 | 7/1969 |
| GB | 1 393 875 | 5/1975 |
| GB | 1 458 206 | 12/1976 |
| GB | 1 473 643 | 5/1977 |
| GB | 1 536 671 | 12/1978 |
| GB | 2 136 775 | 9/1984 |
| GB | 2136775 | 9/1984 |
| JP | 2005-231720 | 9/2005 |
| WO | WO 98/19931 | 5/1998 |
| WO | WO 99/25623 | 5/1999 |
| WO | WO 2005/084372 | 9/2005 |
| WO | WO 2005108233 | 11/2005 |
| WO | WO 2009/000829 | 12/2008 |
| WO | WO 2012122137 A1 * | 9/2012 |

OTHER PUBLICATIONS

U.S. Appl. No. 29/408,136, filed Dec. 7, 2011, Pipes.
U.S. Appl. No. 29/408,139, filed Dec. 7, 2011, Bailey.
U.S. Appl. No. 13/538,400, filed Jun. 29, 2012, Pipes.
IMACS User's Guide; 471—Tin Cans—Aug. 2001 (9 pgs.).
Shabby Chic Advertising Tin Vintage Mahogany Flake Tobacco by ChocolateBoxCottage; Tobacco tin alleged to have been on-sale prior to 1950; Website visited Feb. 10, 2014; http://www.etsy.com/listing/129091690/shabby-chic-advertising-tin-vintage?ref=sr_gallery_29&ga_search_query=tobacco+tin&ga_ga_view_type =gallery &ga_ship_to=US&ga_page=35&ga_search_type=all.
Photo of top of Medicated No. 99 Snuff container. Exact public availability date unknown, but believed to be before Jan. 11, 2013 for purposes of examination. (IMG_20140031_161225_476).
Photo of interior of Medicated No. 99 Snuff container. Exact public availability date unknown, but believed to be before Jan. 11, 2013 for purposes of examination. (IMG_20140331_161235_273).
Photo of exterior of Medicated No. 99 Snuff container. Exact public availability date unknown, but believed to be before Jan. 11, 2013 for purposes of examination. (IMG_20140415_090723_768).
Photo of Medicated No. 99 Snuff sealed container. Exact public availability date unknown, but believed to be before Jan. 11, 2013 for purposes of examination. (IMG_20140415_105636_529).
Photo of inner view of Medicated No. 99 Snuff container showing gasket in lid. Exact public availability date unknown, but believed to be before Jan. 11, 2013 for purposes of examination. (IMG_20140415_090800_886).
Photo of Medicated No. 99 Snuff container showing gasket in lid, and exterior and exterior of container. Exact public availability date unknown, but believed to be before Jan. 11, 2013 for purposes of examination. (IMG_20140415_090852_548).
Photo of exteriors of Murrays Erinmore Pipe Tobacco and Dunhill Nightcap Smoking Mixture containers. Containers have Carnaud Metal Box codes on the bottom; Carnaud Metal Box was purchased by Crown in 1996, and therefore the containers are believed to have been publicly available by 1996. (IMG_20140331_161335_917).
Photo of interiors of Murrays Erinmore Pipe Tobacco and Dunhill Nightcap Smoking Mixture containers. Containers have Carnaud Metal Box codes on the bottom; Carnaud Metal Box was purchased by Crown in 1996, and therefore the containers are believed to have been publicly available by 1996. (IMG_20140031_161356_684).
Photo of bottoms of Murrays Erinmore Pipe Tobacco and Dunhill Nightcap Smoking Mixture containers. Containers have Carnaud Metal Box codes on the bottom; Carnaud Metal Box was purchased by Crown in 1996, and therefore the containers are believed to have been publicly available by 1996. (IMG_20140331_161252_390).
Photo of top of Peterson Irish Whiskey Tobacco Product container. Exact public availability date unknown, but believed to be before Jan. 11, 2013 for purposes of examination. (IMG_20140031_100403_976).
Photo of interior of Peterson Irish Whiskey Tobacco Product container. Exact public availability date unknown, but believed to be before Jan. 11, 2013 for purposes of examination. (IMG_20140031_100415_820).
Photo of top of Moontrance Pipe Tobacco container. Exact public availability date unknown, but believed to be before Jan. 11, 2013 for purposes of examination. (IMG_20140331_100441_879).
Photo of bottom of Moontrance Pipe Tobacco container. Exact public availability date unknown, but believed to be before Jan. 11, 2013 for purposes of examination. (IMG_20140331_100451_768).
Photo of interior of Moontrance Pipe Tobacco container. Exact public availability date unknown, but believed to be before Jan. 11, 2013 for purposes of examination. (IMG_20140331_100501_217).
Photo of top of Mac Baren Honey & Chocolate Loose Cut Pipe Tobacco container. Exact public availability date unknown, but believed to be before Jan. 11, 2013 for purposes of examination. (IMG_20140328_154924_558).
Photo of interior of Mac Baren Honey & Chocolate Loose Cut Pipe Tobacco container. Exact public availability date unknown, but believed to be before Jan. 11, 2013 for purposes of examination. (IMG_20140328_155015_232).
Photo of bottom of Mac Baren Honey & Chocolate Loose Cut Pipe Tobacco container. Exact public availability date unknown, but believed to be before Jan. 11, 2013 for purposes of examination. (IMG_20140328_154857_504).

(56) References Cited

OTHER PUBLICATIONS

Photo of exterior of lid and interior of base of Flying Dutchman Tobacco Product container. Exact public availability date unknown, but believed to be before Jan. 11, 2013 for purposes of examination. (IMG_20140328_153834_102).

Photo of interior of Flying Dutchman Tobacco Product container. Exact public availability date unknown, but believed to be before Jan. 11, 2013 for purposes of examination. (IMG_20140328_153804_663).

Photo of top of Escudo Navy De Luxe Fine Tobacco container. Exact public availability date unknown, but believed to be before Jan. 11, 2013 for purposes of examination. (IMG_20140328_15706_741).

Photo of interior of Escudo Navy De Luxe Fine Tobacco container. Exact public availability date unknown, but believed to be before Jan. 11, 2013 for purposes of examination. (IMG_20140328_151805_943).

Photo of interior of Escudo Navy De Luxe Fine Tobacco container. Exact public availability date unknown, but believed to be before Jan. 11, 2013 for purposes of examination. (IMG_20140328_151906_518).

Photo of top of Player's Medium Navy Cut Tobacco container. Exact public availability date unknown, but believed to be before Jan. 11, 2013 for purposes of examination. (IMG_20140328_150004_185).

Photo of interior of lid of Player's Medium Navy Cut Tobacco container. Exact public availability date unknown, but believed to be before Jan. 11, 2013 for purposes of examination. (IMG_20140328_150528_201).

Photo of interior of Player's Medium Navy Cut Tobacco container. Exact public availability date unknown, but believed to be before Jan. 11, 2013 for purposes of examination. (IMG_20140328_150408_710).

IDS Packaging Product Information; Metal Closures (Huddersfield) Ltd.; Vacuum Sealed Tins, Tobacco Snuff Packaging; Medicated No. 99 Tin http://www.idspackaging.com/packaging/europe/Vacuum_sealed_tins/111/products.html website visited Aug. 1, 2014.

* cited by examiner

CONTAINER FOR SMOKELESS TOBACCO PRODUCTS AND RELATED PACKAGED PRODUCT ASSEMBLY AND METHOD

FIELD OF THE DISCLOSURE

The present disclosure relates to containers, packaged product assemblies, and methods of use thereof. More particularly, the disclosure relates to packaging for products made or derived from tobacco, or that otherwise incorporate tobacco, and are intended for human consumption in a smokeless form.

BACKGROUND OF THE DISCLOSURE

Various types of containers for dispensing solid objects, particularly solid products intended for human consumption, are known in the art. Such containers are often characterized by a hand-held size that can be easily stored and transported. Exemplary consumable products that are often packaged in such containers include a wide variety of consumer products, including "smokeless" tobacco-related products.

Particularly popular smokeless tobacco products are employed by inserting some form of processed tobacco or tobacco-containing formulation into the mouth of the user. See for example, the types of smokeless tobacco formulations, ingredients, and processing methodologies set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; U.S. Pat. No. 7,694,686 to Atchley et al.; U.S. Pat. No. 7,810,507 to Dube et al.; U.S. Pat. No. 7,819,124 to Strickland et al.; U.S. Pat. No. 7,861,728 to Holton, Jr. et al.; U.S. Pat. No. 7,901,512 to Quinter et al.; U.S. Pat. No. 8,168,855 to Neilsen et al.; and U.S. Pat. No. 8,336,557 to Kumar et al.; U.S. Patent Application Pub. Nos. 2004/0020503 to Williams; 2005/0244521 to Strickland et al.; 2006/0191548 to Strickland et al.; 2007/0062549 to Holton, Jr. et al.; 2008/0029116 to Robinson et al.; 2008/0029117 to Mua et al.; 2008/0173317 to Robinson et al.; 2008/0196730 to Engstrom et al.; 2008/0305216 to Crawford et al.; 2009/0065013 to Essen et al.; and 2010/0291245 to Gao et al.; PCT Pub. Nos. WO 04/095959 to Arnarp et al.; and WO 10/132,444 to Atchley; each of which is incorporated herein by reference.

Representative smokeless tobacco products that have been marketed include those referred to as CAMEL Snus, CAMEL Orbs, CAMEL Strips and CAMEL Sticks by R. J. Reynolds Tobacco Company; GRIZZLY moist tobacco, KODIAK moist tobacco, LEVI GARRETT loose tobacco and TAYLOR'S PRIDE loose tobacco by American Snuff Company, LLC; KAYAK moist snuff and CHATTANOOGA CHEW chewing tobacco by Swisher International, Inc.; REDMAN chewing tobacco by Pinkerton Tobacco Co. LP; COPENHAGEN moist tobacco, COPENHAGEN Pouches, SKOAL Bandits, SKOAL Pouches, RED SEAL long cut and REVEL Mint Tobacco Packs by U.S. Smokeless Tobacco Company; and MARLBORO Snus and Taboka by Philip Morris USA.

Representative types of snuff products, commonly referred to as "snus," are manufactured in Europe, particularly in Sweden, by or through companies such as Swedish Match AB, Fiedler & Lundgren AB, Gustavus AB, Skandinavisk Tobakskompagni A/S and Rocker Production AB. Snus products previously or currently available in the U.S.A. have been marketed under the trade names such as CAMEL Snus Frost, CAMEL Snus Original, and CAMEL Snus Spice, CAMEL Snus Mint, CAMEL Snus Mellow, CAMEL Snus Winterchill, and CAMEL Snus Robust by R. J. Reynolds Tobacco Company.

Snus products, such as CAMEL Snus Original, are commonly supplied in small teabag-like pouches. The pouches are typically a nonwoven fleece material, and contain about 0.4 to 1.5 grams of pasteurized tobacco. These products typically remain in a user's mouth for about 10-30 minutes. Unlike certain other smokeless tobacco products, snus does not require expectoration by the user.

Snus products have been packaged in tins, "pucks" or "pots" that are manufactured from metal or plastic such as those disclosed in U.S. Pat. No. 4,098,421 to Foster and U.S. Pat. No. 4,190,170 to Boyd, and U.S. Patent Application Pub. Nos. 2010/0065076 to Bergstrom et al.; and 2010/0065077 to Lofgreen-Ohrn et al.; each of which is incorporated by reference herein.

A desirable feature for certain containers configured to store a product such as snus is the protection of the product from environmental effects, particularly those effects that may degrade the product stored in the container. For example, in humid environments, moisture may invade the storage space housing the product, thereby damaging the product or otherwise rendering the product unusable. Conversely, moisture may escape the product and exit the storage space, rendering the product overly dry. It would thus be desirable to provide an improved packaging for smokeless tobacco products and the like, wherein the packaging provides various advantageous features, such as protection from environmental effects.

BRIEF SUMMARY OF THE DISCLOSURE

In one aspect, a container is provided. The container may comprise a lid and a base. The lid may comprise a top wall defining an inner surface, a sealing member extending around a perimeter of the top wall at the inner surface, and one or more lid sidewalls extending from the top wall to a lower lip defining a lid opening. The base may be moveable with respect to the lid between a coupled configuration in which a storage compartment defined by the base is substantially sealed shut and a decoupled configuration in which the storage compartment is open. The base may comprise a bottom wall and one or more base sidewalls extending from the bottom wall to an upper lip defining a base opening. The base sidewalls may comprise an outer portion extending from the bottom wall, an inwardly offset portion configured to be received through the lid opening, and an angled portion extending from the inwardly offset portion to the upper lip, the angled portion defining an angle with respect to the inwardly offset portion configured to align the base with respect to the lid during coupling therebetween and further configured to position the upper lip in contact with the sealing member when received through the lid opening.

In some embodiments the upper lip and/or the lower lip may comprise a rolled edge. The inwardly offset portion of the base sidewalls may define one or more protrusions projecting outwardly therefrom and configured to engage the lower lip of the lid via interference fit. Engagement between the protrusions and the lower lip may be configured to bias the upper lip against the sealing member. The angle of the angled portion of the base sidewalls may be from about 35 degrees to about 40 degrees. The top wall of the lid may define a channel at the inner surface thereof in which the sealing member is at least partially received. The channel may define a depth from about 0.5 millimeters to about 1 millimeters. A radius of the channel may be greater than a radius of the upper lip.

In some embodiments an outer surface of the top wall of the lid may define an outwardly protruding portion at the channel. The base sidewalls may further comprise a shoulder portion extending substantially perpendicularly to the outer portion and the inwardly offset portion. The shoulder portion may be configured to define a gap with respect to the lower lip of the lid sidewalls when the lid and the base are configured in the coupled configuration. The base sidewalls may further comprise a recessed portion configured to align with the lower lip of the lid sidewalls of the lid when the lid and the base are configured in the coupled configuration.

In some embodiments the container may be provided in combination with a plurality of units of a product received in the storage compartment. In one embodiment the product may be selected from the group consisting of pharmaceutical products, smoking products, smokeless tobacco products, and consumable products. In another embodiment the product may be a smokeless tobacco product.

In an additional aspect a method for assembling a packaged product assembly is provided. The method may comprise providing a lid and providing a base defining a storage compartment. The lid and the base may comprise the lid and the base described above in some embodiments. The method may also include providing a plurality of units of a product, inserting the units of the product into the storage compartment, and coupling the lid to the base such that the inwardly offset portion of the base sidewalls is at least partially received within the lid sidewalls and the upper lip seals against the sealing member.

In some embodiments coupling the lid to the base may comprise aligning the base with respect to the lid by contacting the angled portion of the base sidewalls with the lower lip of the lid. Coupling the lid to the base may also comprise biasing the upper lip against the sealing member. Biasing the upper lip against the sealing member may comprise directing the lower lip over one or more protrusions projecting outwardly from the base sidewalls.

These and other features, aspects, and advantages of the disclosure will be apparent from a reading of the following detailed description together with the accompanying drawings, which are briefly described below.

BRIEF DESCRIPTION OF THE DRAWINGS

Figure 1:
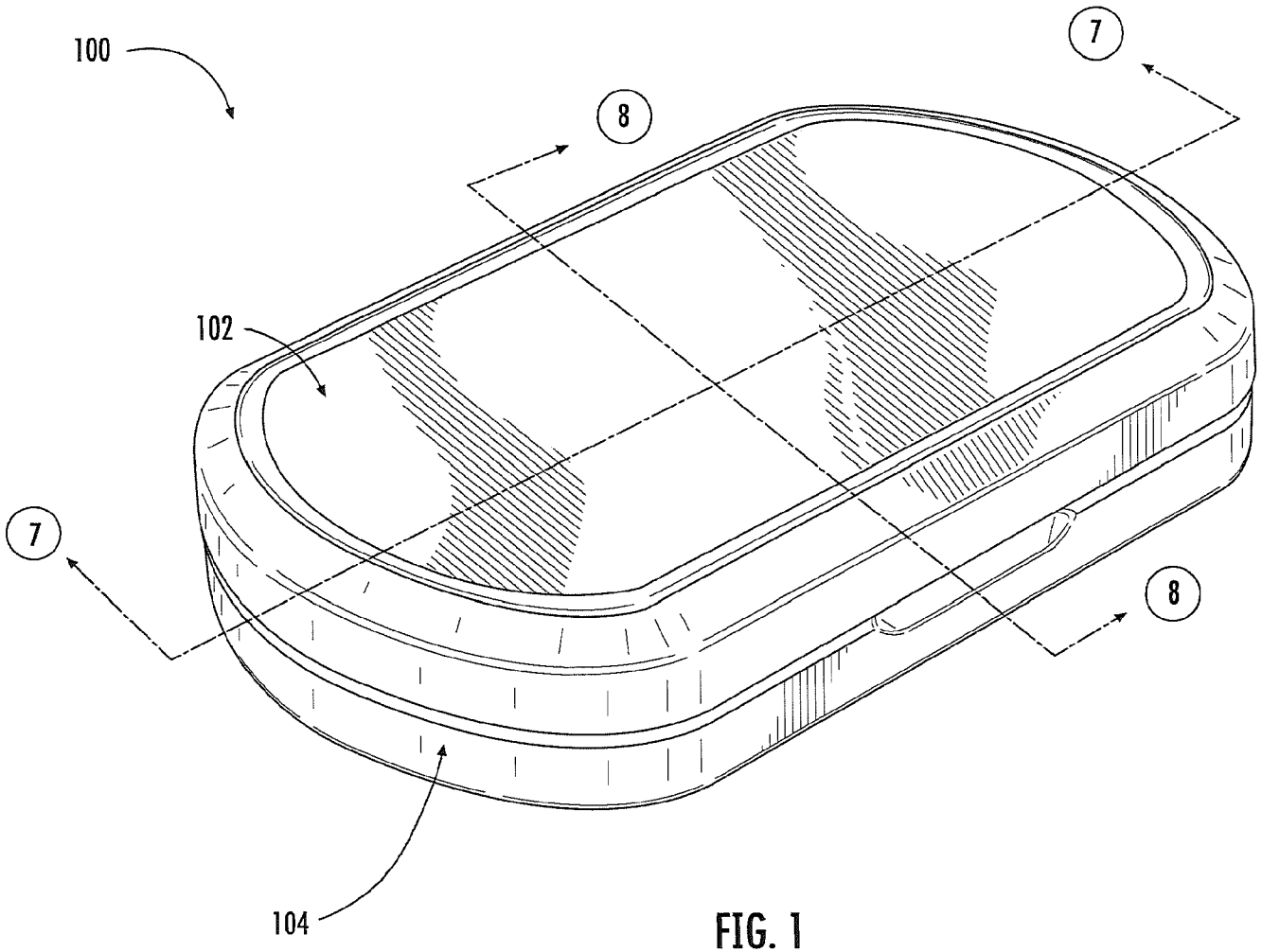
Figure 2:
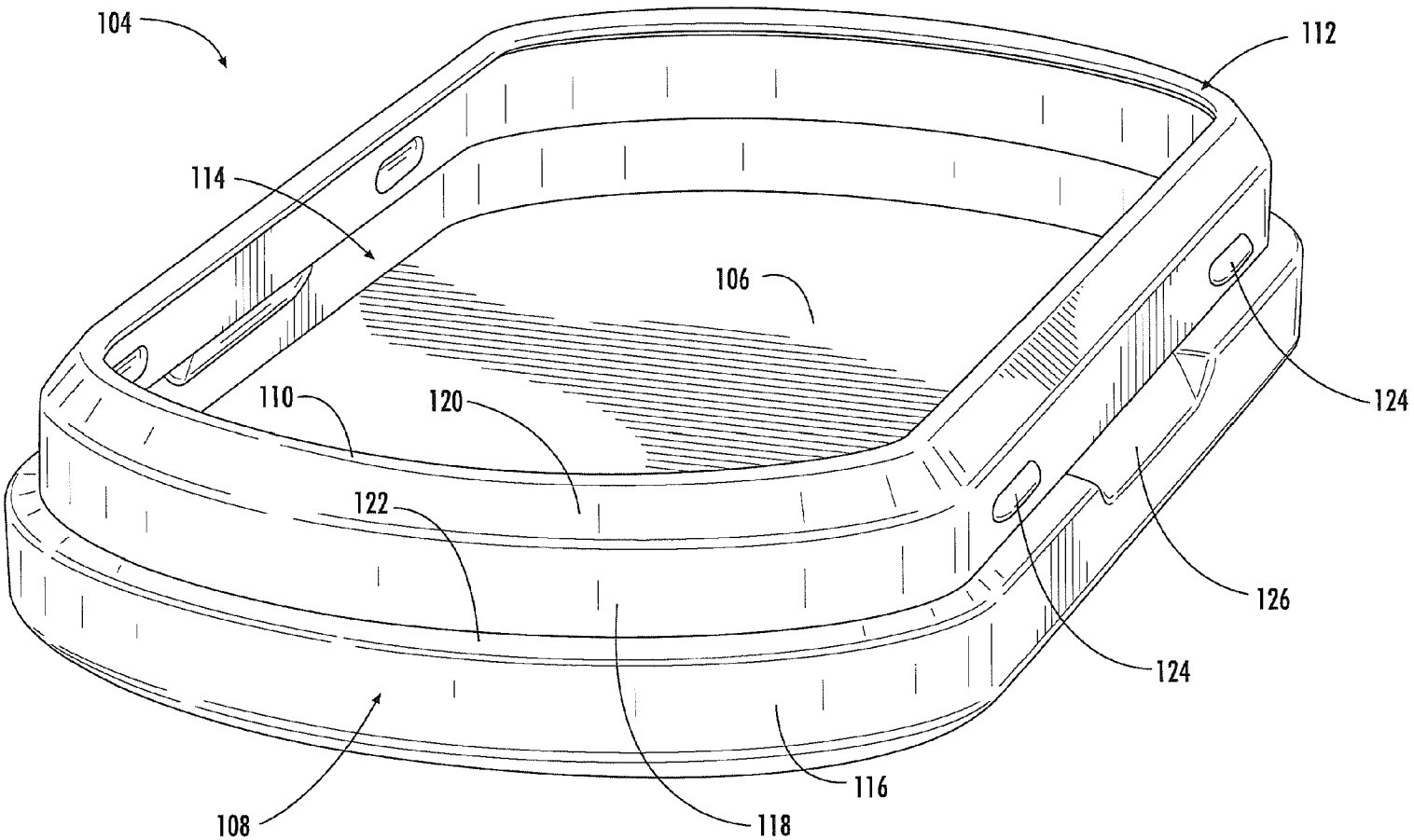
Figure 3:
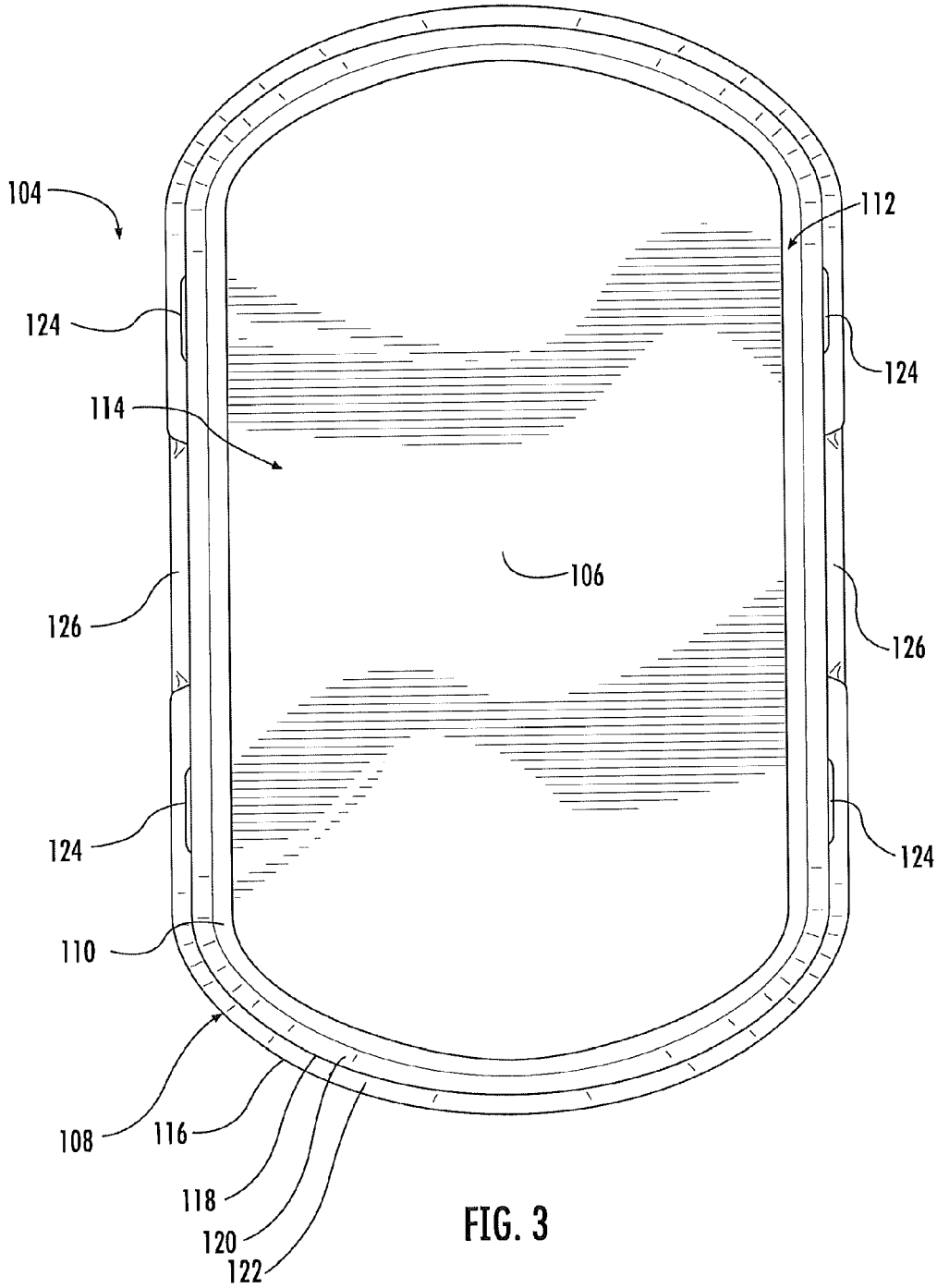
Figure 4:
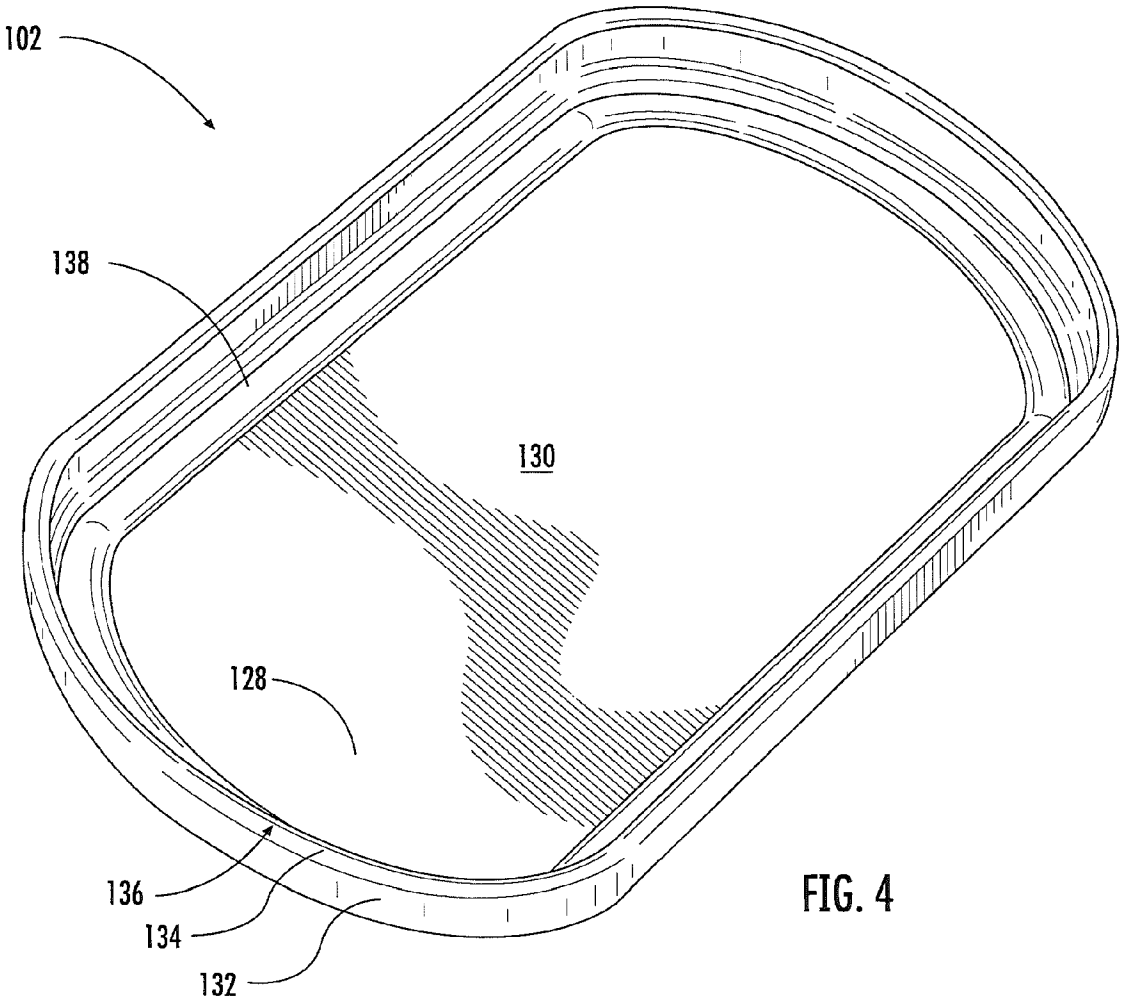
Figure 5:
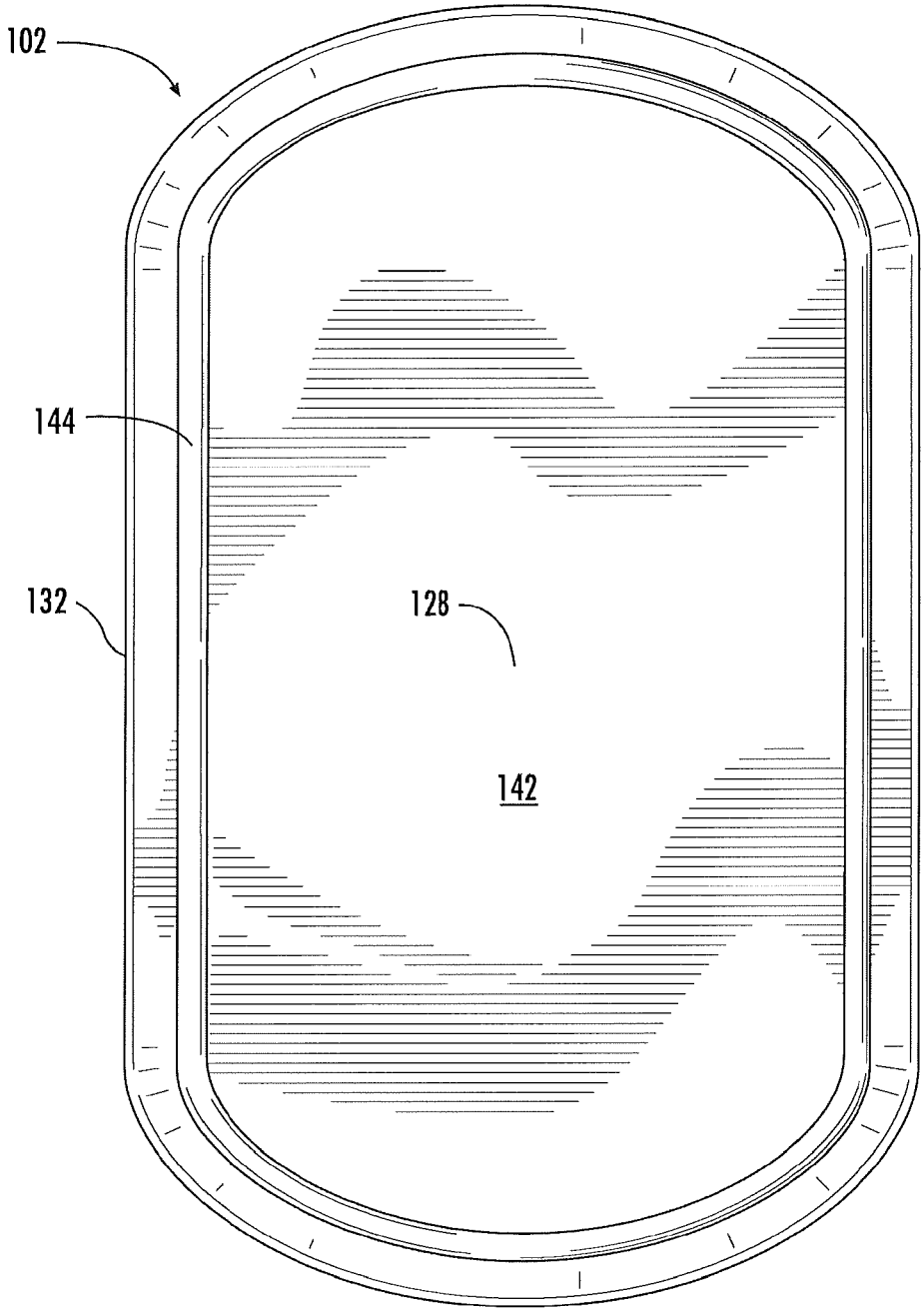
Figure 6:
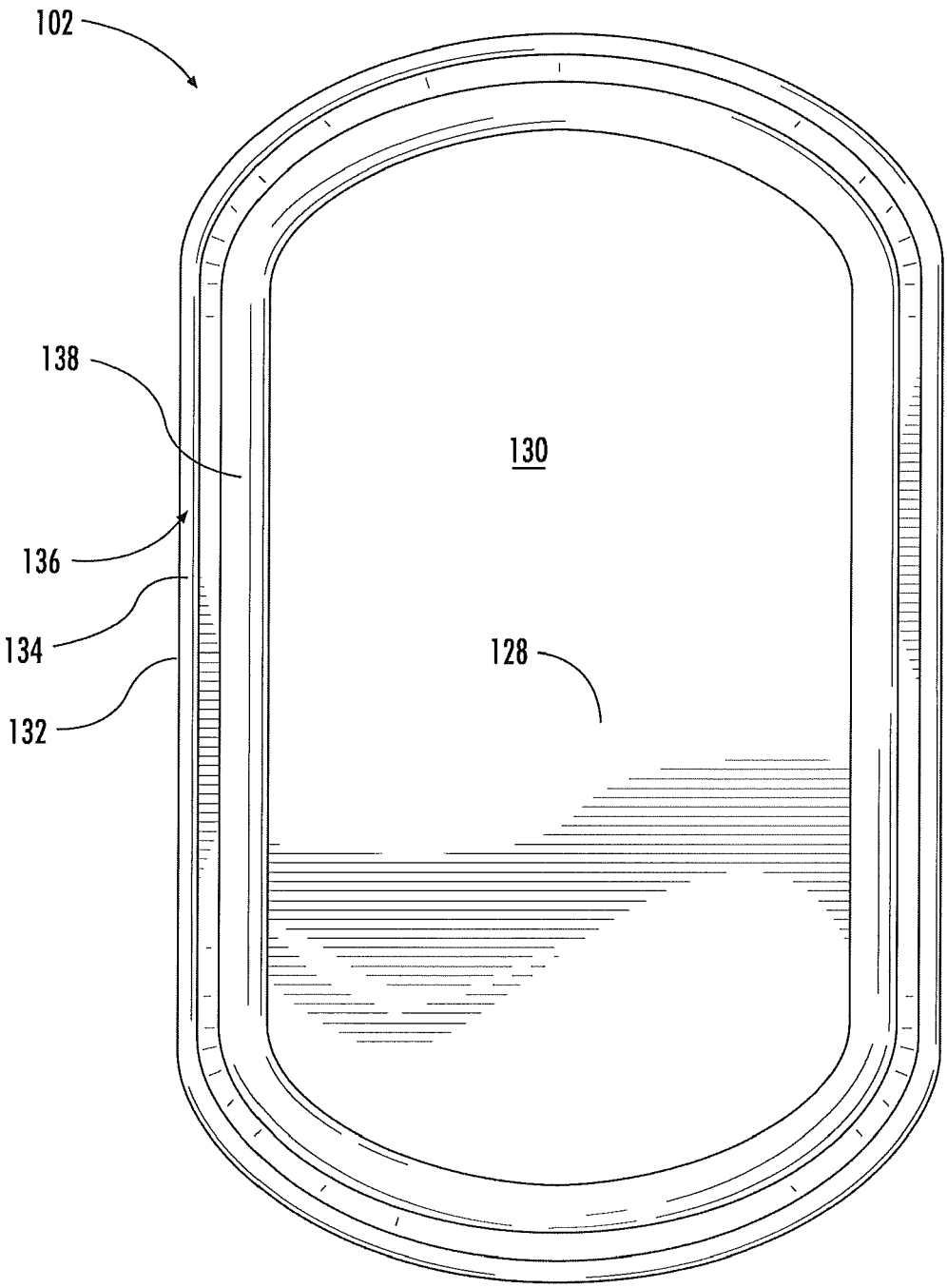
Figure 7:
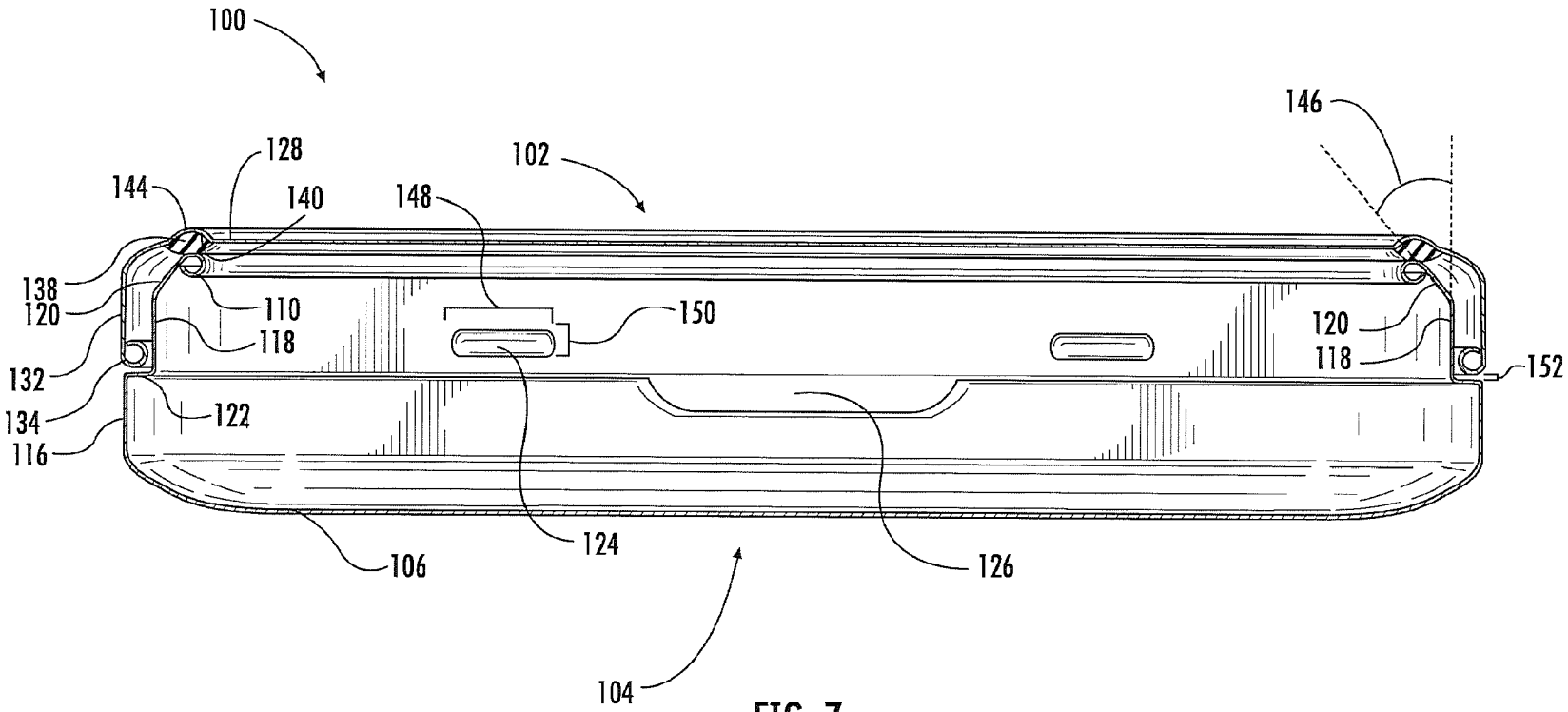
Figure 8:
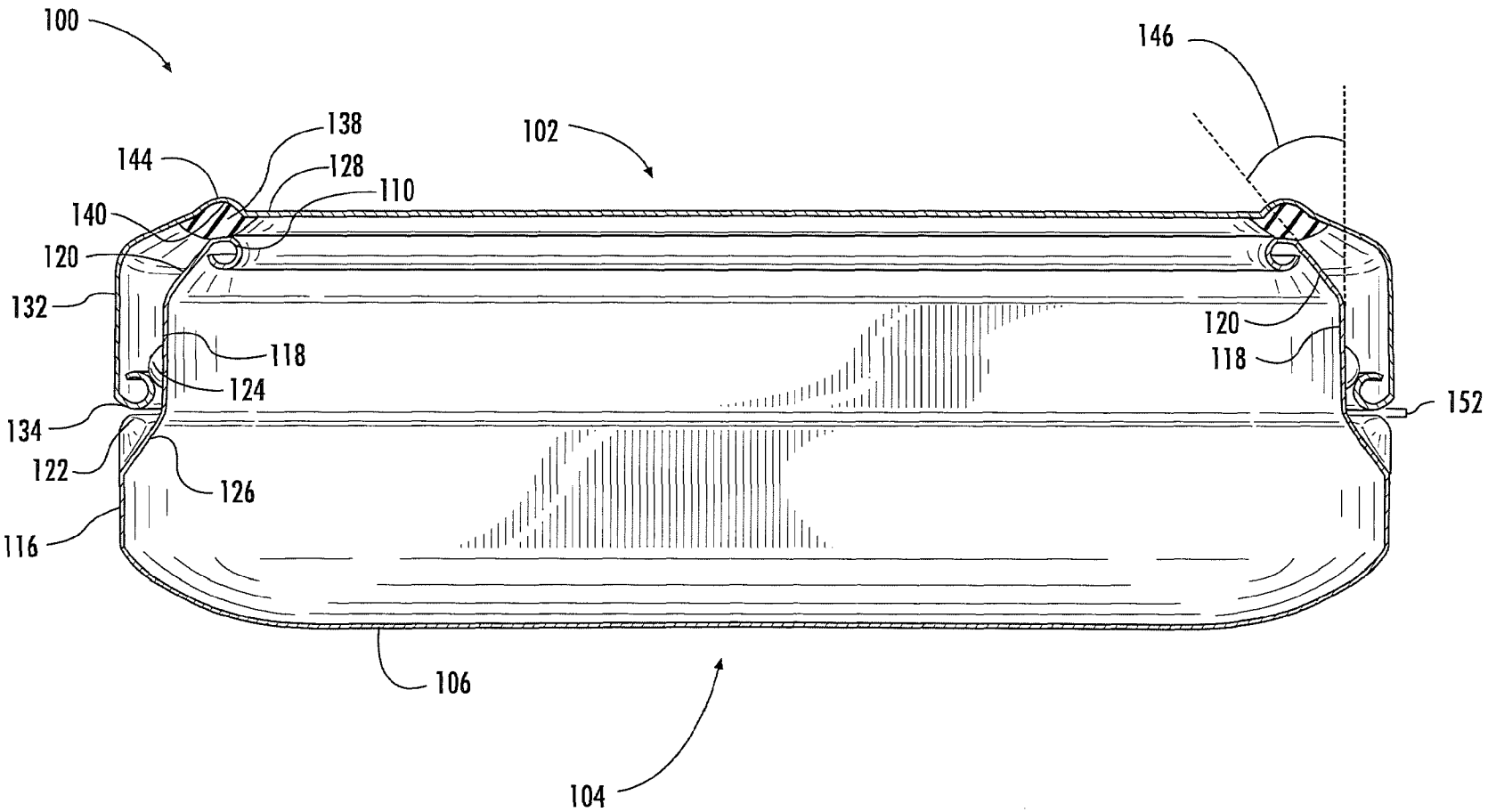
Figure 9:
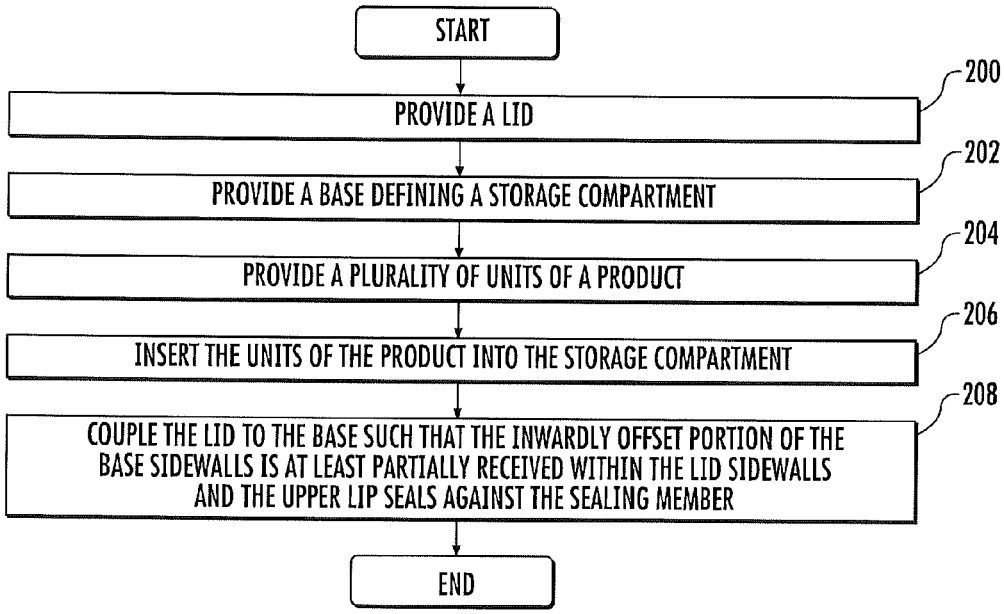

Having thus described the disclosure in general terms, reference will now be made to the accompanying drawings, which are not necessarily drawn to scale, and wherein:

FIG. 1 illustrates a perspective view of a container comprising a lid and a base in a coupled configuration according to an example embodiment of the present disclosure;

FIG. 2 illustrates a perspective view of the base of the container of FIG. 1;

FIG. 3 illustrates a top view looking into the inside of the base of the container of FIG. 1;

FIG. 4 illustrates a bottom perspective view of the lid of the container of FIG. 1;

FIG. 5 illustrates a top view of the lid of the container of FIG. 1;

FIG. 6 illustrates a bottom view looking into the inside of the lid of the container of FIG. 1;

FIG. 7 illustrates a sectional view through the container of FIG. 1 in the coupled configuration along line 7-7;

FIG. 8 illustrates a sectional view through the container of FIG. 1 in the coupled configuration along line 8-8; and FIG. 9 illustrates a schematic view of a method for assembling a packaged product assembly according to an example embodiment of the present disclosure.

DETAILED DESCRIPTION OF THE DISCLOSURE

The present disclosure now will be described more fully hereinafter with reference to certain preferred aspects. These aspects are provided so that this disclosure will be thorough and complete, and will fully convey the scope of the disclosure to those skilled in the art. Indeed, the disclosure may be embodied in many different forms and should not be construed as limited to the aspects set forth herein; rather, these aspects are provided so that this disclosure will satisfy applicable legal requirements. As used in the specification, and in the appended claims, the singular forms "a", "an", "the", include plural referents unless the context clearly dictates otherwise.

The embodiments of containers described in the present application can be used to store a variety of products, but are particularly well-suited for products designed for oral consumption. Exemplary consumable products that are often packaged in such containers include a wide variety of consumer products, including tobacco products in smokeless form.

Exemplary tobacco products include pelletized tobacco products (e.g., compressed or molded pellets produced from powdered or processed tobacco, such as those formed into the general shape of a coin, cylinder, bean, pellet, sphere, orb, strip, obloid, cube, bead, or the like), extruded or cast pieces of tobacco (e.g., as strips, films or sheets, including multilayered films formed into a desired shape), products incorporating tobacco carried by a solid substrate (e.g., where substrate materials range from edible grains to inedible cellulosic sticks), extruded or formed tobacco-containing rods or sticks, tobacco-containing capsule-like materials having an outer shell region and an inner core region, straw-like (e.g., hollow formed) tobacco-containing shapes, sachets or packets containing tobacco (e.g., snus-like products), pieces of tobacco-containing gum, and the like. Further, exemplary tobacco products include tobacco formulations in a loose form such as, for example, a moist snuff product. Exemplary loose form tobacco used with the containers of the present disclosure may include tobacco formulations associated with, for example, commercially available GRIZZLY moist tobacco products and KODIAK moist tobacco products that are marketed by American Snuff Company, LLC.

Exemplary smokeless tobacco compositions that can be packaged in the containers of the present disclosure are set forth in, for example, U.S. Pat. No. 1,376,586 to Schwartz; U.S. Pat. No. 3,368,567 to Speer; U.S. Pat. No. 4,513,756 to Pittman et al.; U.S. Pat. No. 4,606,357 to Dusek et al; U.S. Pat. No. 4,821,749 to Toft et al.; U.S. Pat. No. 5,167,244 to Kjerstad; U.S. Pat. No. 5,387,416 to White; U.S. Pat. No. 6,668,839 to Williams; U.S. Pat. No. 7,810,507 to Dube et al.; U.S. Pat. No. 7,819,124 to Strickland et al.; U.S. Patent Application Pub. Nos. 2005/0244521 to Strickland et al.; 2006/0191548 to Strickland et al.; and 2008/0029116 to Robinson et al. Examples of tobacco-containing gum are set forth in U.S. Pat. No. 4,624,269 to Story et al.; U.S. Pat. No. 4,975,270 to Kehoe; and U.S. Pat. No. 4,802,498 to Ogren. Various manners or methods for packaging smokeless tobacco products are set forth in U.S. Patent Application Pub. Nos. 2004/0217024 and 2006/0118589 to Arnarp et al.; and 2009/

0014450 to Bjorkholm; and PCT Pub. Nos. WO 2006/034450 to Budd; WO 2007/017761 to Kutsch et al.; and WO 2007/067953 to Sheveley et al. All of the above-cited references are incorporated by reference herein in their entirety.

Embodiments of containers for packaging products such as smokeless tobacco products including trays slidably received in housings are described in U.S. Pat. No. 7,946,450 to Gelardi et al.; U.S. Pat. No. 8,066,123 to Gelardi; U.S. Pat. No. 8,087,540 to Bailey et al.; U.S. Pat. No. 8,096,411 to Bailey et al.; and U.S. Patent Application Pub. Nos. 2011/0000931 to Gelardi et al. and 2010/0133140 to Bailey et al. U.S. Pat. No. 8,033,425 to Gelardi describes a hinged container for packaging products such as smokeless tobacco products. U.S. Pat. No. 6,736,261 to Thomas et al. and U.S. Pat. No. 7,014,039 to Henson et al. disclose metal containers for tobacco products with a sliding lid. U.S. Patent Application Pub. No. 2012/0193265 to Patel et al. describes a container for packaging products such as smokeless tobacco products including a separable lid and base with vent channels. U.S. Patent Application Pub. No. 2011/0204074 to Gelardi et al. describes a container for packaging products such as smokeless tobacco products including an outer casing and a dispensing tray. U.S. patent application Ser. No. 13/488,627 to Bailey, filed Jun. 5, 2012, describes a container for packaging products such as smokeless tobacco products including a base and a lid configured to pivot and slide between open and closed positions. U.S. patent application Ser. No. 13/538,400 to Pipes et al., filed Jun. 29, 2012 discloses hinging containers with blister packs received therein. All of the above-cited references are incorporated by reference herein in their entirety.

Smokeless tobacco compositions utilized as the product contained in the containers of the present disclosure will often include ingredients such as tobacco (typically in particulate form), sweeteners, binders, colorants, pH adjusters, fillers, flavoring agents, disintegration aids, antioxidants, oral care additives, and preservatives. See, for example, U.S. Pat. No. 7,861,728 to Holton et al., which is incorporated by reference herein in its entirety.

The tobacco formulation can be contained within a container, such as a pouch or bag, such as is the type commonly used for the manufacture of snus types of products (e.g., a sealed, moisture permeable pouch that is sometimes referred to as a "portion"). A representative moisture permeable pouch can be composed of a "fleece" type of material. The tobacco formulation is in turn contained within a package, such as the containers of the present disclosure described more fully hereinbelow. The package is sealed, and is composed of a suitable material, such that the atmospheric conditions within that sealed package are modified and/or controlled. That is, the sealed package can provide a good barrier that selectively or non-selectively inhibits the passage of compositions such as moisture and oxygen therethrough. For example, the seal or gasket can be useful for inhibiting ingress of moisture while also allowing for egress of gas. In addition, the atmosphere within the sealed package can be further modified by introducing a selected gaseous species (e.g., nitrogen, argon, or a mixture thereof) into the package prior to sealing or by drawing a vacuum therein (vacuum sealing). As such, the atmospheric conditions to which the tobacco composition is exposed are controlled during conditions of one or more of preparation, packing, storage and handling. An exemplary pouch may be manufactured from materials, and in such a manner, such that during use by the user, the pouch undergoes a controlled dispersion or dissolution. Such pouch materials may have the form of a mesh, screen, perforated paper, permeable fabric, or the like. For example, pouch material manufactured from a mesh-like form of rice paper, or perforated rice paper, may dissolve in the mouth of the user. As a result, the pouch and tobacco formulation each may undergo complete dispersion within the mouth of the user during normal conditions of use, and hence the pouch and tobacco formulation both may be ingested by the user. Other exemplary pouch materials may be manufactured using water dispersible film forming materials (e.g., binding agents such as alginates, carboxymethylcellulose, xanthan gum, pullulan, and the like), as well as those materials in combination with materials such as ground cellulosics (e.g., fine particle size wood pulp). Preferred pouch materials, though water dispersible or dissolvable, may be designed and manufactured such that under conditions of normal use, a significant amount of the tobacco formulation contents permeate through the pouch material prior to the time that the pouch undergoes loss of its physical integrity. If desired, flavoring ingredients, disintegration aids, and other desired components, may be incorporated within, or applied to, the pouch material.

Descriptions of various components of snus products and components thereof also are set forth in U.S. Patent Application Pub. No. 2004/0118422 to Lundin et al., which is incorporated herein by reference. See, also, for example, U.S. Pat. No. 4,607,479 to Linden; U.S. Pat. No. 4,631,899 to Nielsen; U.S. Pat. No. 5,346,734 to Wydick et al.; and U.S. Pat. No. 6,162,516 to Derr, and U.S. Patent Application Pub. No. 2005/0061339 to Hansson et al.; each of which is incorporated herein by reference. See, also, the representative types of pouches, and pouch material or fleece, set forth in U.S. Pat. No. 5,167,244 to Kjerstad, which is incorporated herein by reference. Snus products can be manufactured using equipment such as that available as SB 51-1/T, SBL 50 and SB 53-2/T from Merz Verpackungmaschinen GmBH. G.D SpA out of Italy also supplies tobacco pouching equipment. Snus pouches can be provided as individual pouches, or a plurality of pouches and can be connected or linked together (e.g., in an end-to-end manner) such that a single pouch or individual portion can be readily removed for use from a one-piece strand or matrix of pouches.

Although example embodiments of containers are illustrated in the drawings and described herein, it should be understood that the shape of the containers of the disclosure can vary. For example, although the container embodiments illustrated in the drawings have certain contours, containers with other exterior surface designs could also be used. Further, the sides or edges of the containers of the disclosure could be flattened, rounded, or beveled, and the various surfaces or edges of the container exterior could be concave or convex. Further, the opposing sides, ends, or edges of the container can be parallel or non-parallel such that the container becomes narrower in one or more dimensions. Additionally, although the example embodiments of dimensions described herein are provided in order to achieve certain benefits, the dimensions may vary in other embodiments.

The number of solid product units stored in the containers of the disclosure can vary, depending on the size of the container and the size of the product units. Typically, the number of stored product units will vary from about 5 to about 100, more typically about 10 to about 50, and most often about 15 to about 30.

FIG. 1 illustrates a perspective view of a container 100 according to an example embodiment of the present disclosure. The container 100 may comprise a lid 102 and a base 104. The lid 102 and the base 104 may be configurable between a coupled configuration and a decoupled configuration. FIG. 1 illustrates the lid 102 and the base 104 in a coupled configuration in which the lid is coupled to the base.

In the coupled configuration one or more units of a product may be stored therein. In one embodiment the product may be a smokeless tobacco product. In another embodiment the product may be selected from the group consisting of pharmaceutical products, smoking products, smokeless tobacco products, and consumable products. However, various other embodiments of products may be stored in the container 100.

The material of construction of the container 100 can vary. In a preferred embodiment, both the lid 102 and the base 104 are formed from a metallic material, such as tin, aluminum, steel, or tin coated steel plate. In this regard, as described below, plastisol or other heated fluid sealing members may be applied to the metal without causing damage thereto. In some embodiments the lid 102 and the base 104 may be respectively formed from a single sheet of metal via punching, stamping, trimming, forming the sheet of metal and/or via other operations. In one embodiment the metal may define a thickness from about 0.1 millimeters to about 0.3 millimeters, and in a preferred embodiment about 0.19 millimeters. This thickness may provide the container 100 with adequate structure and allow the container to operate as described herein.

Various other materials may be employed in other embodiments including for example, wood and synthetic plastic materials. Polymeric materials that can be extruded and/or molded into desired shapes may be utilized, such as polyethylene, polystyrene, polyamide, and the like. In one embodiment the base 104 may be formed from a polymeric material, while the lid 102 may be formed from a metallic material such as, for example, aluminum or tinplate. Such a configuration may be advantageous in that it may provide an aesthetically appealing appearance by using a metallic material to form the lid 102 (which is typically stamped), while also allowing the body to be less expensively produced using, for example, an injection molding process. Further, plastisol or other heated fluid sealing members may still be applied to the lid 102 in the manner described above.

The lid 102 and the base 104 may also be configured to a decoupled configuration in which the lid and the base are separated from one another. In this regard, FIG. 2 illustrates a perspective view of the base 104 and FIG. 3 illustrates a top view of the base. As illustrated, the base 104 may comprise a bottom wall 106 and one or more base sidewalls 108. The base sidewalls 108 may extend from the bottom wall 106 to an upper lip 110. The upper lip 110 may define a base opening 112 that provides access to an internal storage compartment 114. The internal storage compartment 114 may store one or more units of product therein in the coupled configuration (see, e.g., FIG. 1) and provide access to the units of product via the base opening 112 in the decoupled configuration (see, e.g., FIGS. 2 and 3) in which the storage compartment 114 is open.

The base sidewalls 108 may comprise an outer portion 116, which extends from the bottom wall 106. The base sidewalls 108 may further comprise an inwardly offset portion 118 and an angled portion 120. The angled portion 120 may extend from the inwardly offset portion 118 to the upper lip 110. The base sidewalls 108 may further comprise a shoulder portion 122 extending substantially perpendicularly to the outer portion 116 and the inwardly offset portion 118. The shoulder portion 122 may connect the outer portion 116 to the inwardly offset portion 118.

The inwardly offset portion 118 of the base sidewalls 108 may define one or more protrusions 124 projecting outwardly therefrom. The base sidewalls 108 may further comprise one or more recessed portions 126. Each recessed portion 126 may extend from the outer portion 116 to the inwardly offset portion 118. However, whereas the shoulder portion 122 of the base sidewalls 108 may extend substantially perpendicularly to the outer portion 116 and the inwardly offset portion 118, the recessed portion 126 may extend at an angle that is non-parallel and non-perpendicular to the outer portion and the inwardly offset portion. As described below, this configuration may allow the recessed portion 126 to provide a user with access to the lid 102 when the lid is coupled to the base 104.

FIGS. 4-6 illustrate the lid 102 of the container 100 (see, e.g., FIG. 1). In particular, FIG. 4 illustrates a perspective view of the lid 102, FIG. 5 illustrates a top view of the lid, and FIG. 6 illustrates a bottom view of the lid. As illustrated, the lid 102 may comprise a top wall 128 defining an inner surface 130. One or more lid sidewalls 132 may extend from the top wall 128 to a lower lip 134 defining a lid opening 136. Further, a sealing member 138 may extend around a perimeter of the top wall 128 at the inner surface 130 thereof.

In this regard, as illustrated in FIGS. 7 and 8, which are sectional views through the container 100 in the closed position along lines 7-7 and 8-8 in FIG. 1, the top wall 128 of the lid 102 may define a channel 140 at the inner surface 130 thereof in which the sealing member 138 may be at least partially received. The channel 140 may define a depth from about 0.5 millimeters to about 1 millimeters and/or a radius from about 1 millimeter to about 1.2 millimeters in some embodiments. In a preferred embodiment the channel 140 may define a depth of about 0.6 millimeters and define a radius of about 1.1 millimeters.

In one embodiment the sealing member 138 may be formed from a fluid that is directed into the channel 140, such that the channel is partially or completely full, in a fluid form and thereafter cured or otherwise transformed into a solid or semi-solid form (e.g., a gel). For example, the sealing member 138 may comprise plastisol that is directed into the channel 140 and cured therein via the application of heat. As the plastisol is heated, the plastisol may transfer from a fluid form to an air-filled gel matrix. During the transformation from fluid to air-filled gel matrix, the plastisol may expand outwardly from the channel 140. Accordingly, the above-noted dimensions of the channel 140 may be selected to result in a sealing member 138 defining desired dimensions.

In embodiments in which the sealing member 138 is applied to the lid 102 as a fluid and cured therein, the lid may comprise a material capable of being heating without suffering damage thereto. For example the lid 102 may comprise a metal such as tin, aluminum, steel, or tin coated steel plate. In contrast, embodiments of plastics and other materials having a melting point less than a temperature at which the plastisol is cured may not be employed to form the lid 102 in this embodiment, since the material may melt during the curing process.

Although the plastisol (or other fluid) is described above as being directed into the channel 140 to form the sealing member 138, in another embodiment the entirety of the inner surface 130 (see, e.g., FIG. 4) of the top wall 128 of the lid 102 may be coated with plastisol (or other fluid), which may then be cured to form a sealing member extending across the entirety of the inner surface of the top wall of the lid. In this embodiment, the channel 140 may be omitted from the top wall 128. However, this embodiment may employ more plastisol than is necessary, since sealing contact with the sealing member may only occur at specific locations, as will be described below, such that coating the inner surface 130 (see, e.g., FIG. 4) of the top wall 128 of the lid 102 may be more expensive and produce a container that is heavier than necessary.

Further, the sealing member 138 may comprise various other embodiments of materials. For example, the sealing member 138 may comprise rubber, plastic, or various other embodiments of elastomeric materials configured to form a seal. In particular, any material suitable for forming a resilient gasket can be used according to the present disclosure. These materials may be glued or otherwise coupled to the inner surface 130 (see, e.g., FIG. 4) of the top wall of the lid 102, rather than applied as a fluid and cured therein.

As illustrated in FIG. 5, an outer surface 142 of the top wall 128 of the lid 102 may comprise an outwardly protruding portion 144 at the channel 140 (see, e.g., FIG. 7), which may extend about the perimeter of the top wall. In this regard, the channel 140 (see, e.g., FIG. 7) may be stamped into the top wall 128 of the lid 102 in some embodiments such that the top wall is concave at the inner surface 130 (see, e.g., FIG. 4) and convex at the outer surface 142. The outwardly protruding portion 144 of the top wall 128 at the channel 140 (see, e.g., FIG. 7) may provide a user with grip when holding the container 100 (see, e.g., FIG. 7).

As illustrated in FIGS. 7 and 8, the outwardly protruding portion 144 of the top wall 128 at the channel 140 may extend past a remainder of the lid 102 and collectively define a planar surface. Thus, the outwardly protruding portion 144 of the top wall 128 at the channel 140 may be employed to support the container 100 in a stable manner when the container is placed with the lid 102 down on a surface, and elevate the container 100 such that grasping and lifting the container off of the surface is facilitated.

When the lid 102 and the base 104 are moved from the decoupled configuration to the coupled configuration illustrated in FIGS. 1, 7, and 8, the angled portion 120 of the base sidewalls 108 may align the base 104 with respect to the lid 102 when the lid is placed on the base. In this regard, the angled portion 120 of the base sidewalls 108 may define an angle 146 with respect to the inwardly offset portion 118. Accordingly, the upper lip 110 of the base 104 may be received with clearance within the lid opening 136 to the lid 102 such that a degree of tolerance is provided with respect to the lower lip 134 when the lid and the base are moved into contact with one another during coupling therebetween. Thus, even when a user misaligns the lid 102 and the base 104, the angled portion 120 of the base sidewalls 108 may bring the base and the lid into alignment. Accordingly, movement of the lid 102 and the base 104 from the decoupled configuration to the coupled configuration may be facilitated.

Further, when the lid 102 and the base 104 are moved to the coupled configuration, the storage compartment 114 defined by the base may be substantially sealed shut. In this regard, the upper lip 110 of the base 104 may contact and seal against the sealing member 138 of the lid 102 when the lid and the base are moved to the coupled configuration. The angle 146 defined by the angled portion 120 of the base 104 with respect to the inwardly offset portion 118 may be configured to position the upper lip 110 in contact with the sealing member 138 when the upper lip, the angled portion, and the inwardly offset portion are received through the lid opening 136. More particularly, the angle 146 defined by the angled portion 120 may be configured to center the upper lip 110 of the base 104 with respect to the channel 140 and/or the sealing member 138.

In one embodiment the angle 146 of the angled portion 120 of the base sidewalls 108 may be from about thirty-five degrees to about forty degrees. In a preferred embodiment the angle 146 of the angled portion may be about 38.3 degrees. Use of these values for the angle 146 may provide the container 100 with a more compact form as compared to embodiments of containers defining a substantially straight base sidewall extending substantially perpendicular to a lid when coupled therewith. The above-noted values of the angle 146 may provide a desirable balance between reducing the overall height of the container 100 and providing a sufficient volume of the storage compartment 114 for storage of units of product therein. Note that the angled portion 120 of the base sidewalls 108 may also bend inwardly toward the storage compartment 114. In this regard, the base sidewalls 108 may define an equal thickness at each of the portions thereof. For example, in one embodiment the base 104 and/or the lid 102 may be formed from single pieces of material (e.g., metal) that is stamped, bent, and/or otherwise manipulated to form the container 100. By forming the angled portion 120 of the base sidewalls 108 such that it extends inwardly, the angled portion may define an overhang that facilitates scooping or otherwise engaging a unit of the product stored in the storage compartment 114 with a user's fingers.

The upper lip 110 may be configured to define a substantially airtight seal with the sealing member 138 such that the storage compartment 114 is sealed shut when the lid 102 and the base 104 are in the coupled configuration. In order to form this seal, the upper lip 110 may be continuous around the perimeter of the base opening 112 and define a constant cross-section. Accordingly, no gaps may be created between the sealing member 138 and the upper lip 110. Further, the upper lip 110 may be rounded. In this regard, the upper lip 110 and/or the lower lip 134 may comprise a rolled edge, as illustrated in FIGS. 7 and 8. The upper and/or lower lips 110, 134 may be formed by rolling or bending the material defining the lid and base sidewalls 132, 108 at the distal end thereof. By providing the upper lip 110 and/or the lower lip 134 with a rounded shape, the possibility of injury associated with a user contacting the lips may be reduced. Further, providing the upper lip 110 with a rounded configuration may facilitate engagement with the sealing member 138. In this regard, by rolling, bending, or otherwise transforming an otherwise straight edge of the material defining the base 104 into the rounded upper lip 110, the upper lip may define a greater surface area such that the upper lip may be more likely to form a seal with the sealing member 138 when the lid 102 is coupled to the base 104.

However, the radius of the channel 140 may be greater than radius of the upper lip 110. In this regard, when the channel 140 defines a relatively greater radius than the upper lip 110, a sealing member 138 formed therein (e.g., by curing plastisol therein) may also define a greater radius (or other relatively larger dimensions) as compared to the upper lip. Providing the upper lip 110 with smaller dimensions as compared to the sealing member 138 may allow the upper lip 110 to compress into and be at least partially surrounded by the sealing member 138. Accordingly, a relatively more secure seal may be provided. In one embodiment the upper lip 110 may define a radius from about 0.7 millimeters to about 0.8 millimeters and in a preferred embodiment the radius may be about 0.75 millimeters. In some embodiments the channel 140 may define a radius from about 1 millimeter to about 1.2 millimeters, and in a preferred embodiment the radius may be 1.1 millimeters. However, various other radii may be employed in other embodiments.

In order to retain coupling between the lid 102 and the base 104, the container may include certain features. In this regard, as illustrated in FIG. 8, the protrusions 124 extending from the base sidewalls 108 may be configured to engage the lower lip 134 of the lid 102 via interference fit. Accordingly, interference between the protrusions 124 and the lower lip 134 may resist separation of the lid 102 from the base 104 when the lid and the base are in the coupled configuration.

In one example embodiment the container 100 may be configured such that from about 500 grams-force to about 2000 grams-force is required to decouple the lid 102 from the base 104. Decoupling forces within this range may be desirable because they may provide a satisfying degree of resistance while still allowing for relatively easy decoupling of the lid 102 and the base 104. In some embodiments the selected decoupling force may also provide child resistance.

In order to achieve a desired required decoupling force, various factors may be adjusted. In this regard, a protruding length to which the protrusions 124 protrude perpendicularly from the inwardly offset portion 118 may be controlled. Further, a width 148 of the protrusions 124 and a height 150 of the protrusions may be adjusted (see, e.g., FIG. 7). In some embodiments the protrusions 124 may define a width 148 that is greater than the height 150 of the protrusions. This configuration may provide for an increased area of contact between the protrusions 124 and the lower lip 134 that may increase the decoupling force required to decouple the lid 102 from the base 104.

In one embodiment the height 150 of the protrusions 124 may be from about 2 millimeters to about 2.2 millimeters, and in a preferred embodiment the height may be about 2.1 millimeters. Further, the lower lip 134 of the lid 102 may define a radius from about 0.7 millimeters to about 1 millimeter, and in a preferred embodiment the radius of the lower lip may be about 0.85 millimeters. Additionally, the protrusions 124 may define a protruding length protruding outwardly from the inwardly offset portion 118 of the base sidewalls 108 from about 0.4 millimeters to about 0.6 millimeters, and in a preferred embodiment the protruding length of the protrusions may be about 0.5 millimeters. Selection of the above-noted dimensions may be configured to produce a decoupling force required to separate the lid 102 from the base 104 in the range described above.

The protrusions 124 may also be configured to bias the upper lip 110 of the base 104 into contact with the sealing member 138 on the lid 102. In this regard, engagement between the protrusions 124 and the lower lip 134 may be configured to bias the upper lip 110 against the sealing member 138. Accordingly, a tight seal may be formed between the upper lip of the base 104 and the sealing member 138 of the lid 102 when the container 100 is in the coupled configuration.

In the coupled configuration the shoulder portion 122 of the base sidewalls 108 may be configured to define a gap 152 with respect to the lower lip 134 of the lid sidewalls 132 when the lid 102 and the base 104 are configured in the coupled configuration. In this regard, by providing the gap 152, the lower lip 134 of the lid 102 may have room to bias downwardly due to contact with the protrusions 124. Accordingly, the gap 152 provided by the placement of the shoulder portion 122 may allow the upper lip 110 of the base 104 to seal against the sealing member 138 of the lid 102 as described above.

Note that use of interference fit to hold the lid 102 and the base 104 together may be desirable as compared to other retention methods. In this regard, by way of example, a threaded connection between a base and a lid may produce a seal that is dependent on the extent to which the lid and the base are threaded together. In contrast, in the present embodiment, once the lower lip 134 of the lid 102 extends past the protrusions 124, the lip and the lid may be held together by a force that is independent of the closing force imparted thereon by a user. Thus, for example, the container 100 may not be over or under tightened. Thereby, a desirable seal may be attained, and the decoupling force required to separate the lid 102 from the base 104 may be consistent.

The recessed portions 126 may be configured to align with the lower lip 134 of the lid sidewalls 132 of the lid 102 when the lid and the base 104 are configured in the coupled configuration. Thus, the recessed portions 126 may provide a user with access to the lower lip 134 of the lid 102 in the coupled configuration such that the lid may be decoupled from the base 104. In some embodiments the recessed portions 126 may be positioned such that they are not vertically aligned with the protrusions 124. Thus, when a user grasps the lower lip 134 at the recessed portions 126 and lifts the lid 102 from the base 104, the users fingers may avoid contacting the protrusions 124, which could otherwise potentially impede decoupling of the lid from the base. In the example embodiment, as illustrated in FIG. 7, the recessed portions 126 may be positioned between pairs of the protrusions 124, although various other configurations may be employed. Further, although described as extending from the inwardly offset portion 118, the protrusions may extend from other portions of the base sidewalls 108 or other portions of the container 100 in other embodiments.

In the illustrated embodiment, the container 100 defines a generally rectangular shape with rounded ends. This shape may allow for placement of the protrusions 124 and the recessed portions 126 on the long sides of the base 104. This configuration may be preferable in that it may allow a user to firmly grip the recessed portions 126. However, various other shapes and configurations (e.g., round or square) of the container may be employed in other embodiments.

As noted above, the container 100 may be filled with one or more units of a product. As part of the final packaging process, once the container 100 is filled with the one or more units of a product, the container may be sealed with a circumferential label or wrapper of a pervious or impervious material. In one embodiment a tamper evident shrink band may be wrapped and shrunken around the container such that the lid and the base may not be decoupled without damaging the shrink band. The label or wrapping material useful in accordance with the present disclosure can vary. Typically, the selection of the packaging label or wrapper is dependent upon factors such as aesthetics, tamper resistance and/or indication, desired barrier properties (e.g., so as to provide protection from exposure to oxygen, or so as to provide protection from loss of moisture), or the like. However, as noted above, contact between the upper lip 110 of the base 104 and the sealing member 138 of the lid 102 may provide a seal.

A method for assembling a packaged product assembly is also provided. As illustrated in FIG. 9, the method may include providing a lid at operation 202. The lid may comprise a top wall defining an inner surface, a sealing member extending around a perimeter of the top wall at the inner surface, and one or more lid sidewalls extending from the top wall to a lower lip defining a lid opening. The method may also include providing a base defining a storage compartment at operation 204. The base may comprise a bottom wall and one or more base sidewalls extending from the bottom wall to an upper lip defining a base opening. The base sidewalls may comprise an outer portion extending from the bottom wall, an inwardly offset portion, and an angled portion extending from the inwardly offset portion to the upper lip, the angled portion defining an angle with respect to the inwardly offset portion. The method may additionally include providing a plurality of units of a product at operation 206. Further, the method may include inserting the units of the product into the storage compartment at operation 208. The method may also include coupling the lid to the base such that the inwardly offset portion of the base sidewalls is at least partially received within the lid sidewalls and the upper lip seals against the sealing member at operation 208.

In some embodiments coupling the lid to the base at operation 208 may comprise aligning the base with respect to the lid by contacting the angled portion of the base sidewalls with the lower lip of the lid. Coupling the lid to the base at operation 208 may also comprise biasing the upper lip against the sealing member. Biasing the upper lip against the sealing member may comprise directing the lower lip over one or more protrusions projecting outwardly from the base sidewalls.

Many modifications and other aspects of the disclosure set forth herein will come to mind to one skilled in the art to which the disclosure pertains having the benefit of the teachings presented in the foregoing descriptions and the associated drawings. Therefore, it is to be understood that the disclosure is not to be limited to the specific aspects disclosed and that modifications and other aspects are intended to be included within the scope of the appended claims. Although specific terms are employed herein, they are used in a generic and descriptive sense only and not for purposes of limitation.

That which is claimed:

1. A container, comprising:
- a lid, comprising:
  - a top wall defining an inner surface and a channel at the inner surface;
  - a sealing member extending around a perimeter of the top wall and received in the channel at the inner surface; and
  - one or more lid sidewalls extending from the top wall to a lower lip defining a lid opening,
  - wherein the channel is spaced apart from the one or more lid sidewalls; and
- a base moveable with respect to the lid between a coupled configuration in which a storage compartment defined by the base is substantially sealed shut and a decoupled configuration in which the storage compartment is open, the base comprising:
  - a bottom wall; and
  - one or more base sidewalls extending from the bottom wall to an upper lip defining a base opening, the base sidewalls comprising:
    - an outer portion extending from the bottom wall;
    - an inwardly offset portion configured to be received through the lid opening;
    - an angled portion extending from the inwardly offset portion to the upper lip, the angled portion defining an angle with respect to the inwardly offset portion configured to align the base with respect to the lid during coupling therebetween and further configured to position the upper lip in contact with the sealing member at the channel when received through the lid opening; and
    - one or more protrusions projecting outwardly from the inwardly offset portion and configured to engage the lower lip of the lid via interference fit.

2. The container of claim 1, wherein the upper lip comprises a rolled edge.

3. The container of claim 1, wherein the lower lip comprises a rolled edge.

4. The container of claim 1, wherein engagement between the one or more protrusions and the lower lip is configured to bias the upper lip against the sealing member.

5. The container of claim 1, wherein the angle of the angled portion of the base sidewalls is from about 35 degrees to about 40 degrees.

6. The container of claim 1, wherein the channel defines a depth from about 0.5 millimeters to about 1 millimeters.

7. The container of claim 1, wherein a radius of the channel is greater than a radius of the upper lip.

8. The container of claim 1, wherein an outer surface of the top wall of the lid defines an outwardly protruding portion at the channel.

9. The container of claim 1, wherein the base sidewalls further comprise a shoulder portion extending substantially perpendicularly to the outer portion and the inwardly offset portion.

10. The container of claim 9, wherein the shoulder portion is configured to define a gap with respect to the lower lip of the lid sidewalls when the lid and the base are configured in the coupled configuration.

11. The container of claim 1, wherein the base sidewalls further comprise a recessed portion configured to align with the lower lip of the lid sidewalls of the lid when the lid and the base are configured in the coupled configuration.

12. The container of claim 1 in combination with a plurality of units of a product received in the storage compartment.

13. The container of claim 12, wherein the product is selected from the group consisting of pharmaceutical products, smoking products, smokeless tobacco products, and consumable products.

14. The container of claim 12, wherein the product is a smokeless tobacco product.

15. The container of claim 1, wherein engagement between the one or more protrusions and the lower lip separates the lower lip from the inwardly offset portion proximate the one or more protrusions.

16. A method for assembling a packaged product assembly, comprising:
- providing a lid, comprising:
  - a top wall defining an inner surface and a channel at the inner surface;
  - a sealing member extending around a perimeter of the top wall and received in the channel at the inner surface; and
  - one or more lid sidewalls extending from the top wall to a lower lip defining a lid opening,
  - wherein the channel is spaced apart from the one or more lid sidewalls; and
- providing a base defining a storage compartment, the base comprising:
  - a bottom wall; and
  - one or more base sidewalls extending from the bottom wall to an upper lip defining a base opening, the base sidewalls comprising:
    - an outer portion extending from the bottom wall;
    - an inwardly offset portion; and
    - an angled portion extending from the inwardly offset portion to the upper lip, the angled portion defining an angle with respect to the inwardly offset portion;
- providing a plurality of units of a product;
- inserting the units of the product into the storage compartment; and
- coupling the lid to the base such that the inwardly offset portion of the base sidewalls is at least partially received within the lid sidewalls and the upper lip seals against the sealing member at the channel,
  - wherein coupling the lid to the base comprises biasing the upper lip against the sealing member by directing the lower lip over one or more protrusions projecting outwardly from the inwardly offset portion of the base sidewalls.

17. The method of claim 16, wherein coupling the lid to the base comprises aligning the base with respect to the lid by contacting the angled portion of the base sidewalls with the lower lip of the lid.

18. The method of claim 16, wherein coupling the lid to the base comprises engaging the one or more protrusions with the lower lip such that the lower lip remains separated from the inwardly offset portion proximate the one or more protrusions.

19. The method of claim 16, wherein coupling the lid to the base comprises providing a gap between the lower lip of the lid sidewalls of the lid and a shoulder portion of the base sidewalls extending substantially perpendicularly to the outer portion and the inwardly offset portion of the base sidewalls.

* * * * *